US006836931B2

(12) United States Patent
Bone

(10) Patent No.: US 6,836,931 B2
(45) Date of Patent: Jan. 4, 2005

(54) LOCKING MECHANISM FOR DUST COLLECTION MODULE OF VACUUM CLEANER

(75) Inventor: Daniel Bone, Langley Moore (GB)

(73) Assignee: Black & Decker Inc., Newark, DE (US)

( * ) Notice: Subject to any disclaimer, the term of this patent is extended or adjusted under 35 U.S.C. 154(b) by 198 days.

(21) Appl. No.: 10/091,374

(22) Filed: Mar. 4, 2002

(65) Prior Publication Data

US 2003/0005547 A1 Jan. 9, 2003

(30) Foreign Application Priority Data

Jul. 6, 2001 (GB) ..... 0116588

(51) Int. Cl.[7] ..... A47L 9/14

(52) U.S. Cl. ..... 15/352; 15/331; 15/338; 55/429; 55/DIG. 3

(58) Field of Search ..... 15/352, 331, 338; 55/DIG. 3, 429

(56) References Cited

U.S. PATENT DOCUMENTS

| | | | | |
|---|---|---|---|---|
| 4,545,794 A | | 10/1985 | Himukai | 15/352 |
| 4,601,735 A | | 7/1986 | Morton, Jr. | 55/377 |
| 4,928,347 A | | 5/1990 | Krasznai et al. | 15/344 |
| 5,218,736 A | | 6/1993 | Bartasevich et al. | 15/344 |
| 5,659,922 A | * | 8/1997 | Louis | 15/352 |
| 5,664,285 A | * | 9/1997 | Melito et al. | 15/352 |
| 6,256,834 B1 | * | 7/2001 | Meijer et al. | 15/352 |
| 6,261,331 B1 | | 7/2001 | Fleurier et al. | 55/374 |
| 6,317,920 B1 | * | 11/2001 | Brickner et al. | 15/352 |
| 6,385,810 B1 | * | 5/2002 | Lang | 15/352 |
| 6,502,277 B1 | * | 1/2003 | Petersson et al. | 15/352 |

FOREIGN PATENT DOCUMENTS

| | | |
|---|---|---|
| EP | 0 966 912 | 12/1999 |
| GB | 1 262 121 | 2/1972 |
| GB | 2 344 863 | 6/2000 |

OTHER PUBLICATIONS

Search Report from United Kingdom Patent Office, dated Sep. 19, 2001.

* cited by examiner

*Primary Examiner*—Theresa T. Snider
(74) *Attorney, Agent, or Firm*—Harness, Dickey & Pierce, P.L.C.

(57) ABSTRACT

A removable dust collection module (5) for use with vacuum cleaners as well as a vacuum cleaner incorporating such modules and a method of detachably securing the dust collection module (5) to a vacuum cleaner housing. The dust collection module is slidably received within a vacuum cleaner housing and comprises a latch member (81) that can move from a first position, in which it engages with the housing of the vacuum cleaner (1) to retain the dust collection module within the vacuum cleaner, to a second position out of engagement with the vacuum cleaner to allow the dust collection module to be removed. The latch member is displaceable from its first to second position by activation of a slideable release member (7) which is actuated by an end user so as to lock or unlock the dust collection module.

29 Claims, 8 Drawing Sheets

LOCKING MECHANISM FOR DUST COLLECTION MODULE OF VACUUM CLEANER

TECHNICAL FIELD

This invention relates to a locking mechanism suitable for detachably securing a dust collection module to a vacuum cleaner housing.

BACKGROUND OF THE INVENTION

Removable dust collection modules contained within vacuum cleaners are known. For example EP-A-9783865 (Application number 97300134.0-2316, Black and Decker Inc) describes a known bagless vacuum cleaner comprising a floor travelling head comprising a housing member that incorporates a removable dust collection bowl in a hole in the housing towards the front of the floor travelling head. The dust collection module includes an integral handle moulded therein on its upper surface, for use in removing the dust collection module. A floor nozzle leads through a single front inlet of the dust collection module and air and entrained dust, dirt and debris enters through this inlet into the dust collection module and exits through a back filter-covered face of the module. The large area of the dust collection module causes air velocity in the receiving area to be smaller than at the inlet, allowing the entrained dirt, dust and debris to fall into the dust collection module. The module therefore needs to be emptied regularly by the user, and removal is effected by lifting the module upwards out of the housing using the integrally moulded handle. Notches are provided in the side walls of the dust collection module which interact with cantilevered snap-lock latches located in the side walls of the hole of the housing in which the dust collection module sits. The latches retain the dust collection module in the hole in the housing but can deflect outward when sufficient upward force is exerted on the handle at the top of the dust collection unit. They therefore allow the dust collection module to be removed for emptying, but prevent the dust collection module slipping out of the housing during normal use or storage.

We have found that for some applications It may be desirable to have a latch mechanism that can provide more positive locking of the dust collection module in a vacuum cleaner housing than Is provided by the notches and snap-lock latches of EP-A-9753865 (Application number 97300134.0-2316. Black and Decker Inc). We have also found that while this more positive locking mechanism may be desirable for any normal vacuum operation since it ensures that the dust collection module Is released only for emptying, it is especially advantageous to provide the more positive locking arrangement on the dust collection module at times when another part is being moved relative to the dust collection module, since this relative movement could otherwise cause accidental removal of the dust collection module.

SUMMARY OF THE INVENTION

A first aspect of the present invention provides a locking mechanism for detachably securing a removable dust collection module to a vacuum cleaner housing comprising:

(i) a latch member that can move from a first position in which, in use, it can engage part of the vacuum cleaner housing to a second position in which, in use, it is free from the vacuum cleaner housing; and (ii) a release member that is movable relative to the latch member, the movement causing the latch member to move from its first to second position.

The invention also provides a kit of parts comprising the said locking mechanism in combination with a removable dust collection module of a vacuum cleaner, the latch member being retained to the dust collection module so that movement of the latch member relative to the dust collection module in at least one direction is restricted, and preferably substantially prevented.

The removable dust collection module and locking mechanism combination are preferably provided contained within part of a vacuum cleaner housing, and another aspect of the invention provides a vacuum cleaner housing containing the dust collection module and locking mechanism combination. The dust collection module is preferably removable by extraction from the vacuum cleaner housing in the said first direction, and the restricted direction of movement of the latch member relative to the dust collection module is preferably also in the said first direction.

Since the movement of the latch member in one direction relative to the dust collection module is restricted (and preferably substantially prevented), and in a first position the latch member can engage part of the vacuum cleaner housing, this means that in the first position of the latch member, if a force is exerted onto the dust collection in the said first direction then movement of the dust collection module itself relative to the housing in this first direction is restricted, and preferably substantially prevented. Thus the latch is effectively fixed to the dust collection module, and can hold or release the dust collection module from the housing part of the vacuum cleaner when a force is exerted in the said first direction.

Preferably the latch mechanism can move in one direction, or in opposed directions along a common line, in order to engage part of the vacuum cleaner housing. Movement of the latch member in all other directions is preferably restricted, especially preferably substantially prevented.

In the vacuum cleaner containing the dust collection module and locking mechanism kit of parts, the dust collection module is removed by lifting it up through an upper surface of the vacuum cleaner housing. Preferably the said first direction in which movement of the latch member relative to the dust collection module is restricted is the said upward lifting direction of the dust collection module. However sideways or other direction removable dust collection modules are also envisaged, and in these cases the said first direction is preferably the same said sideways or other direction.

The latch member is preferably an elongate member, and preferably comprises a resilient biasing portion, especially a spring, preferably separating two end housing-engagement portions. The end housing-engagement portions are preferably also elongate members, and are preferably mirror images of each other.

The movement of the release member is preferably in a direction substantially perpendicular to the elongate latch member, and the release member is preferably movable relative to the latch member to provide a force against the biasing force provided by the biasing portion of the latch member. Preferably the release member is moveable from a first release-member-position in which it in contact with the latch member, to a second release-member-position in which it is not in contact the latch member.

Thus for example when the release member contacts the latch member and exerts a force that acts against the biasing force of the spring or other biasing portion of the latch member, the housing engagement portions come closer, and when the release member loses contact with the latch member, the biasing force of the biasing portion of the latch member causes the housing-engagement portions of the latch member to move away from each other, i.e. the latch member shortens when contacted by the release member and lengthens when not contacted by the release member. Arrangements in which the converse applies, i.e. the latch lengthens when contacted by the release member and shortens when not contacted by the release member are also envisaged.

Preferably the release member is movable relative to the latch member such that when the release member is in the said first release-member-position where it is in contact with the latch member then the latch member is in its second position in which it is free from the housing part. However an arrangement in which the converse is true is also envisaged, i.e. when the release member is in contact with the latch member then the latch member can engage the housing part.

Preferably the release member is provided with at least one cam surface, and most preferably the latch member is provided with a corresponding cam surface, and the cam surfaces can slide over each other to effect the said movement of the latch member from its first to second position.

In one embodiment the release member comprises two cam surfaces, and the latch member comprises two end, housing-engagement portions, each of which is provided with a cam surface shaped to correspond with respective ones of the cam surfaces on the release member.

Preferably the or each cam surface on the release member is provided with a bearing, and the or each cam surface of the latch member is provided with a recess shaped to co-operate in a friction fit with the corresponding bearing. The bearing may be a ball bearing or a strip bearing, and is preferably made of a bearing metal.

In an especially preferred embodiment, the release member comprises a substantially flat portion, and the cam surfaces are preferably provided on that flat portion, preferably on a lower edge of that flat portion.

The latch member of the locking mechanism is preferably at least partly contained within a dust collection module. The dust collection module is preferably hollow, and especially preferably cup shaped. Where the latch member is contained at least partly within the dust collection module, the said restriction of movement of the latch member relative to the dust collection module is preferably at least partly achieved by the provision of inwardly directed flanges that project from an inwardly facing surface of the dust collection module. In an especially preferred embodiment the latch mechanism rests on the inside bottom surface of the dust collection module, and flanges directed inwardly from a side face of the dust collection module extend above the latch mechanism to restrict, and preferably substantially to prevent, upward motion of the latch mechanism relative to the dust collection module.

The release member is preferably a separate part, and is preferably removable from the vacuum cleaner. In a preferred embodiment, in use, it is preferably contained within the dust bowl at least in part of its movement relative to the dust bowl. Preferably a backing plate is also provided positioned so as to locate the release member between itself and the dust collection module. Preferably the backing plate is positioned so as to provide a channel in which the release member can slide.

The backing plate may itself be at least partly contained within the dust collection module. In an especially preferred embodiment, the latch member is contained within the dust collection module adjacent one surface thereof, and part of the backing plate is positioned substantially to prevent movement of the latch member further into the dust collection module. Preferably the latch member is adjacent the front or a side surface of the dust collection module and part of the backing plate is behind the latch member to hold it against the front or side surface.

Preferably the release member is positioned adjacent a surface, especially the front or side surface of the dust bowl, and the release member has a surface that preferably corresponds to at least part of an inwardly facing surface of the dust collection module, and preferably has a surface that corresponds in shape to at least part of the opposed surface of the backing plate.

Preferably, the dust collection module comprises an air inlet and the release member also acts as an air inlet closure member, and movement of the release member relative to the latch member also moves the release member relative to the dust collection module and acts simultaneously to close a first air flow path into the dust collection module and open a second air flow path, that is remote from the first air flow path, into the dust collection module.

In one embodiment, the dust collection module comprises two air inlets and the release member also acts as an air inlet closure shuttle member, whereby movement of the release member relative to the latch member causes the release member to slide relative to the dust collection module simultaneously to cover a first of the air inlets of the dust collection module and open a second of the air inlets of the dust collection module or vice versa.

In a specific design, the dust collection module comprises two air inlets and the release member is a shuttle member containing an opening, whereby movement of the release member relative to the latch member causes the release member to move relative to the said air inlets of the dust collection module so that in a first shuttle position the first, but not the second, air inlet of the dust collection module of the vacuum cleaner is in register with the shuttle opening, and in a second shuttle position the second, but not the first, air inlet of the dust collection module of the vacuum cleaner is in register with the or another shuttle opening. Most preferably the shuttle member comprises first and second openings and the closure member can be moved relative to the said air inlets so that in a first shuttle position the first air inlet of the dust collection module of the vacuum cleaner is in register with the first shuttle opening but the second air inlet of the dust collection module is not in register with any shuttle opening, and in a second shuttle position the second air inlet of the dust collection module of the vacuum cleaner is in register with the second shuttle opening, but the first air inlet of the dust collection module is not in register with any shuttle opening.

Preferably the release member is in contact with a surface of the dust collection module. It preferably slides relative to the said surface. Also it preferably remains in contact with the said dust collection module surface throughout its movement relative thereto.

The present invention also provides a method of detachably securing a removable dust collection module to a vacuum cleaner housing, comprising:

(i) providing a kit of parts according to the invention comprising a dust collection module and a locking mechanism according to the present invention;

(ii) locating the dust collection module in a vacuum cleaner housing; and (iii) moving the release member of the locking mechanism relative to the latch member of the locking mechanism to cause the latch member to move from a first position in which it engages part of the vacuum cleaner housing to a second position in which it is free from the vacuum cleaner housing.

BRIEF DESCRIPTION OF THE DRAWINGS

Embodiments of the present invention will now be described, with reference to the accompanying drawings, wherein.

DETAILED DESCRIPTION OF THE PREFERRED EMBODIMENTS

Figure 1A:
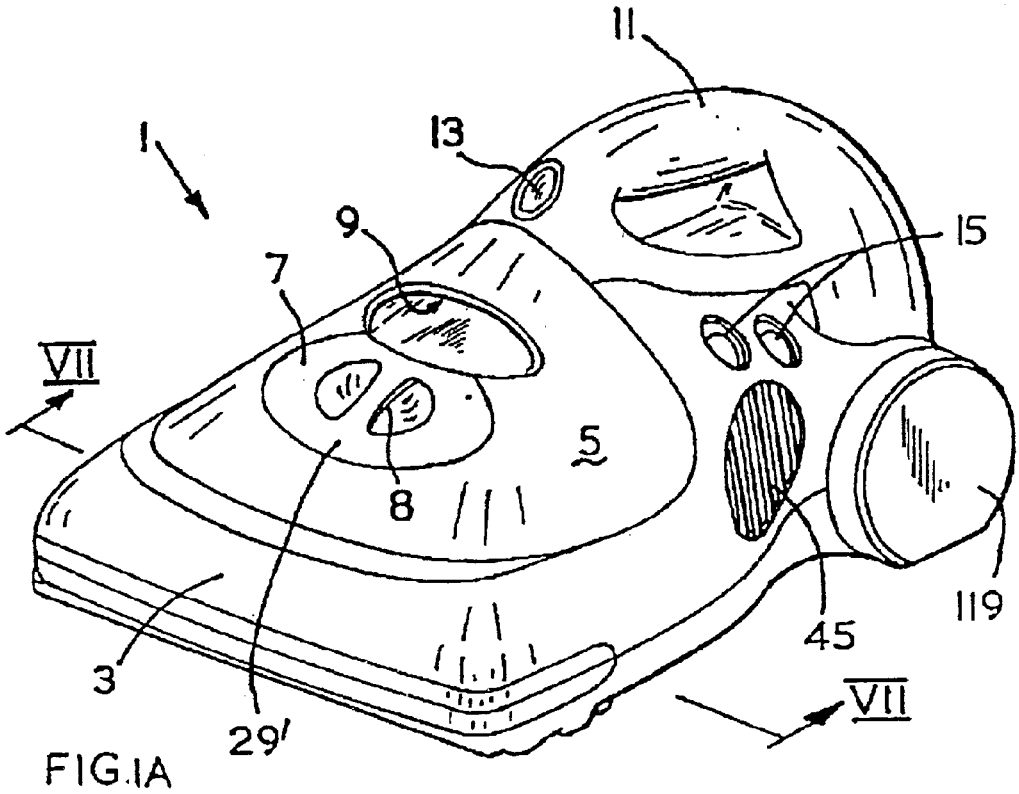
FIGS. 1A and 1B are perspective views of a vacuum cleaner according to the present invention showing the release shuttle member of the locking mechanism of the invention in lowered and raised position respectively.
Figure 1B:
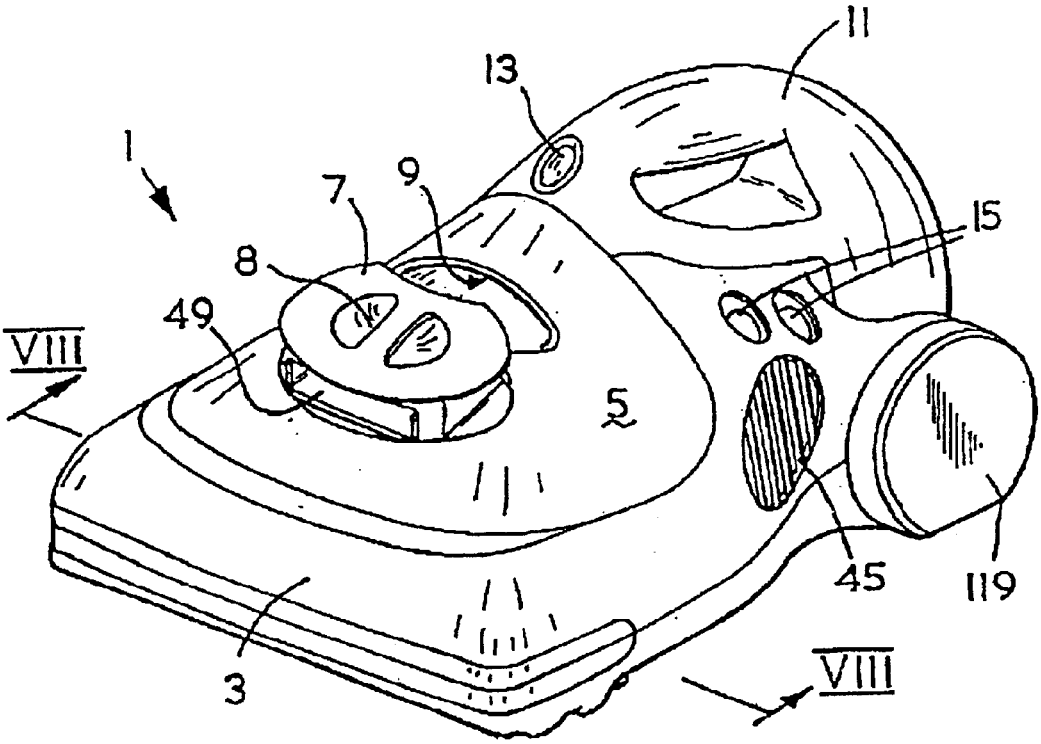

Referring to the drawings, FIGS. 1A and 1B show a vacuum cleaner 1 comprising a main housing portion 3 containing a dust bowl 5. The dust bowl 5 is removable, and removal is effected by upward lifting by the user of integrally moulded handle 9. A shuttle member 7 is located within the dust bowl 5. It can be raised and lowered relative to the dust bowl 5, and is shown in its lowered position in FIG. 1A and in its raised position in FIG. 1B. A latch member (not visible in FIGS. 1A and 1B) is contained within and retained in position relative to the dust bowl 5, and when the shuttle member 7 is in its raised position in FIG. 1B, the latch member is moved to a position in which the dust bowl is locked in position relative to the housing portion 3, i.e. it can not be removed from the housing portion 3, but when the shuttle member 7 is in its lowered position shown in FIG. 1A the latching is de-activated and the dust bowl 5 is not locked in position relative to the housing portion 3, and therefore can be removed for emptying by the user by lifting handle 9. Thus the shuttle member 7 acts as a release member to activate and de-activate a latch member This is described in more detail below, particularly with reference to FIGS. 4 and 5. The latch member (not visible in FIG. 1) and the shuttle member 7, which is a release member for the latch, together provide the locking mechanism according to the present invention.

The shuttle member 7 also acts as an air flow path modifier. When the shuttle member 7 is shown in its lowered position in FIG. 1A air flows through a floor inlet in the vacuum cleaner housing 3, and when the shuttle member is in its raised position in FIG. 1B the floor inlet is closed, and air flows instead through upper inlet 49 (see FIG. 1B), which is suitable for hose attachment. The action of the shuttle member to change the air flow path into the dust bowl 5 for floor or hose attachment use is described in more detail below with reference to FIGS. 7 and 8.

Thus the shuttle member 7 has dual purpose, acting as part of a releasable locking mechanism to secure the dust bowl relative to the housing, and also as an air flow path modifier.

The vacuum cleaner 1 as shown in FIGS. 1A and 1B also includes a handle 11 detachably secured to the main housing portion 3 by depressible spring biased buttons 13 and 15 in a known manner. As shown the cleaner is suitable for hand-propelled use over a floor or surface. If desired the detachable handle 11 can be replaced by a long handle to convert the vacuum cleaner to upright use.

The vacuum cleaner shown is powered by rechargeable batteries, and a rechargeable mount for electrical connection to a mains charging supply is provided under the removable cap 19, which may be a screw or push fit attachment. It is also envisaged that the vacuum cleaner could be powered by an AC power source.

The vacuum cleaner housing portion 3 also contains side vents 45 for air outlet, as described in more detail with reference to FIG. 3.

Housing and handle parts 3 and 11, dust bowl 5 and shuttle member 7 preferably each comprise moulded polymeric material.

Figure 2:
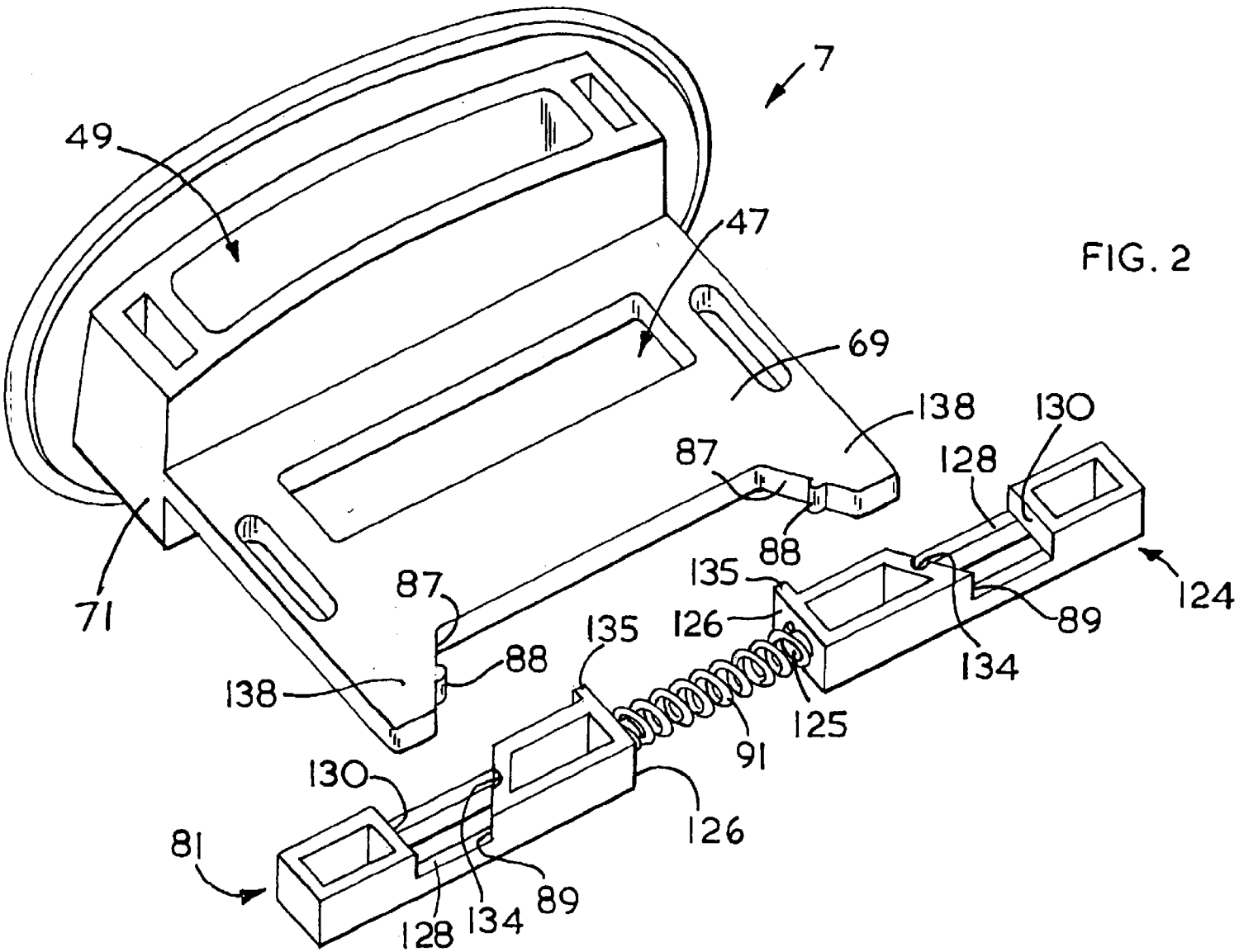
FIG. 2 is a perspective view of the latch member and release shuttle member forming the locking mechanism according to the present invention.

FIG. 2 shows in more detail the component parts of the locking mechanism according to the present invention. The locking mechanism basically comprises two component parts; a latch member 81, and a release member, which is the shuttle member 7 shown in FIG. 1.

Considering first the latch member 81, this is an elongate member that comprises a central metal helical spring 91 and two elongate end housing-engagement-portions 124 secured to the spring 91 at either end thereof. The spring is of uniform cross section and is located at either end around projecting stubs 125 on the inwardly facing ends 126 of each of the housing engagement portions 124. Each end housing-engagement portion 124 is a solid elongate part. It is substantially rectangular in cross-section. Each end housing engagement portion has a recessed portion 128 of smaller thickness part way along its length. Each recessed portion 128 is bounded by a first straight surface 130 extending substantially perpendicular to the axis of the elongate latch member 81 on the outer side of the recessed portion 128, and a second sloping cam surface 89 on the inner side of the recessed portion 128. The second sloping cam surface 89 contains a channel shaped groove 134 part way along its surface, extending into the thickness of the end housing-engagement portions 124. The inwardly facing ends 126 of each of the end housing-engagement portions 124 comprise a flange 135 projecting to the side facing the shuttle member 7 as shown in FIG. 2.

The spring 91 comprises a spring metal, and the end housing-engagement portions 124 are injection moulded and comprise a polymeric material.

Considering now the release member or shuttle member 7 also shown in FIG. 2, this comprises a first lower, substantially flat portion 69 integrally moulded with a second upper block shaped portion 71. The uppermost surface of the shuttle member 7 is slightly curved to form the contoured outer surface of the vacuum cleaner.

The lower surface of the flat portion 69 of the shuttle release member 7 is provided with shaped end projecting portions 138. Each end projecting portion 138 is formed with a side face that is an extension of the side face of the flat portion 69 of the shuttle member 7 and an inwardly facing cam surface 87 Each cam surface 87 is provided with a metallic ball bearing or strip bearing 88.

In operation the shuttle member 7 is pushed into the latch member 81 so that the end projecting portions 138 of the shuttle member 7 slide into the recessed portions 128 of the latch member 81. At this point the cam surfaces 87 of the shuttle member 7 slide relative to the cam surfaces 89 of the latch member, causing the spring 91 of the latch member 81 to compress, and the end housing engaging portions 124 of the latch member 81 move towards each other. Lifting of the shuttle member relative to the latch causes the cam surfaces to separate, and the spring 91 expands causing the end housing-engagement portions 124 to move away from each other. These reversible movements of the latch member 81 can be used to disengage and engage a housing portion of the vacuum cleaner, as described in more detail below, especially with reference to FIGS. 4 and 5.

Ball or strip bearings 88, which are metallic and positioned on the cam surfaces 87 of the shuttle member 7, engage the grooves 134 in the cam surfaces of the end housing-engagement portions of the latch member. This retains the parts together against a small separating force, but can be overcome by applying a larger separating force. Bearings 88 on the cam surfaces 87 of the shuttle member are provided to form friction engagement between the cam surfaces 87 and 89, which must be overcome by the operator to lift the shuttle member 7.

The shuttle member 7 contains two air inlets; a first inlet in the form of a slot shaped aperture 47 in the first substantially flat portion 69 of the shuttle member 7, and a second air inlet in the form of a tubular inlet 49 of generally rectangular cross section through the block shaped portion 71 of the shuttle member. The purpose of these air inlets is to co-operate with inlets in the dust bowl 5 when required, in order to modify the air flow path into the dust bowl 5. This is described in more detail below, especially with reference to FIGS. 7 and 8.

Figure 3:
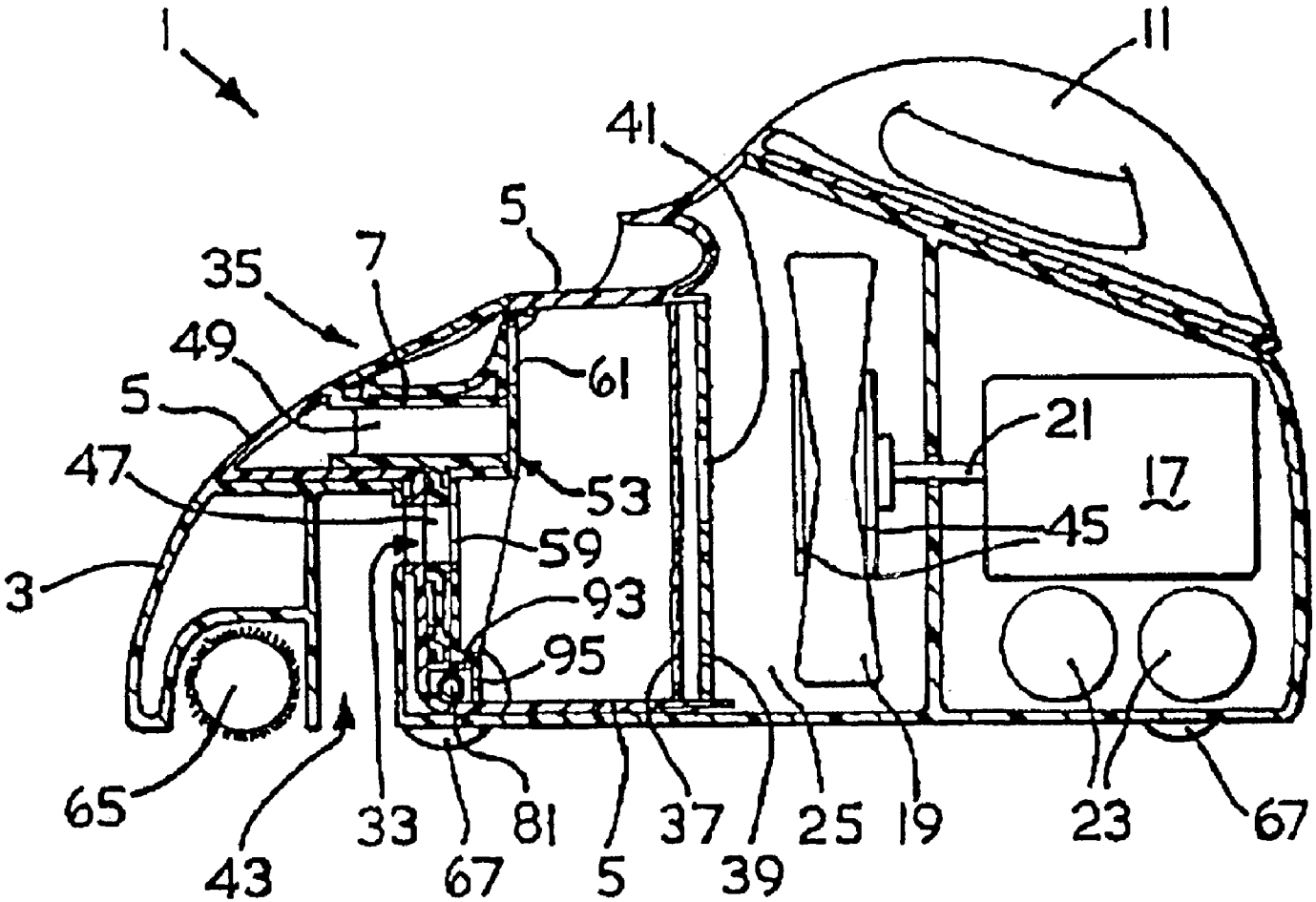
FIG. 3 is a longitudinal sectional view through the vacuum cleaner of FIG. 1A.

FIG. 3 illustrates the manner in which the shuttle release member 7 and latch member 81 are located within the vacuum cleaner, and also illustrates the other operating parts of the vacuum cleaner.

From FIG. 3 it can be seen that the main housing portion 3 of the vacuum cleaner comprises a motor 17 driving an impeller or fan 19 via a drive shaft 21. The motor is adjacent to and electrically connected to rechargeable batteries 23. Two are visible in the section of FIG. 2, but there would usually be four or six batteries. The fan 19 is located in a fan chamber 25, that is located immediately behind the dust collection bowl 5. Air vents 45 are provided on the side surfaces of the fan chamber 25 (see also FIGS. 1A and 1B).

The dust collection bowl 5 is generally cup shaped. It contains two air inlets 33, 35 in a common face, i.e. the front face, of the dust bowl 5. Shuttle release member 7 is located within the dust bowl 5, and lies against part of the inner surface of the front face of the dust bowl 5. A shuttle backing plate 53, which is also located within the dust bowl 5 and secured to the dust bowl 5 (securement not shown in FIG. 2), sandwiches the shuttle member 7 between it and the inner surface of the front face of the dust bowl 5, thereby providing a channel within which the shuttle member 7 can slide relative to the dust bowl 5. The rear face of the dust bowl 5 is covered by a filter member 37 and a back cover plate 39 spaced therefrom, and containing an air outlet 41. The bottom surface of the vacuum cleaner comprises an air inlet 43, which is in communication with the first air inlet 33 into the dust bowl 5.

Latch member 81 is contained within the dust bowl 5 and rests on the bottom surface of the dust bowl 5. It is shown end-on in FIG. 3. Upward motion of the latch member 81 relative to the dust bowl 5 is substantially prevented by flanges 93 that project from the front face of the dust bowl into the dust bowl 5, just above the latch member 81. Similarly movement of the latch member 81 into the body of the dust bowl (i.e. to the right in the orientation shown in FIG. 3) is substantially prevented by a stepped portion 95 of the backing plate 53, which stepped portion 95 lies behind the latch member 81. Therefore the latch member 81 is substantially fixed relative to the dust bowl in all directions other than into and out of the page. Movement into and out of the page is allowed, and indeed is used to engage and disengage the housing portion 3 of the vacuum cleaner, as described in more detail below, with reference to FIGS. 5 and 6 in particular.

Shuttle release member 7 and shuttle backing plate 53 each comprise two air inlets; shuttle member 7 comprising inlets 47 and 49, and shuttle backing plate 53 comprising inlets 59 and 61. In the position shown in FIG. 3 air inlet 33 in the dust bowl 5 is in register with the air inlet 47 in shuttle member 7 and with air inlet 59 into the backing plate 53, but inlet 35 into dust bowl 5 is blocked by part of the shuttle member 7. Movement of the shuttle member relative to the dust bowl 5 and shuttle backing plate 53 can be carried out to alter the air flow path into the dust bowl 5, and this is described in more detail with reference to FIGS. 7 and 8.

In operation, in the shuttle position shown in FIG. 3, the motor 17 drives fan 19 causing air and dust, dirt or debris to be sucked into the suction inlet 43 on the bottom surface of the vacuum cleaner. The air and entrained dust, dirt or debris travel via the inlet 43, through the first inlet 33 of the dust bowl, the aperture 47 in the shuttle 7, and the aperture 59 in the shuttle backing plate 53 and into the dust bowl 5. The large size of the receiving area of the dust bowl causes air velocity in the dust bowl to be smaller than at the entrance 33. This allows the entrained dirt, dust and debris to fall into the dust bowl 5. Air then travels through the filter 37 and the opening 41 in the back cover 39 of the dust bowl 5, and is pushed by the fan 19 out of the housing 3 via the vents 45 in the side surfaces of the housing.

The vacuum cleaner also has a front brush 65 which may be separately powered (not shown), and which is surrounded by housing portions so as to separate it from the front air inlet 43 into the vacuum cleaner, thereby ensuring that suction power is not reduced. Wheels 67 are also provided on the lower surface of the vacuum cleaner.

Figure 4:
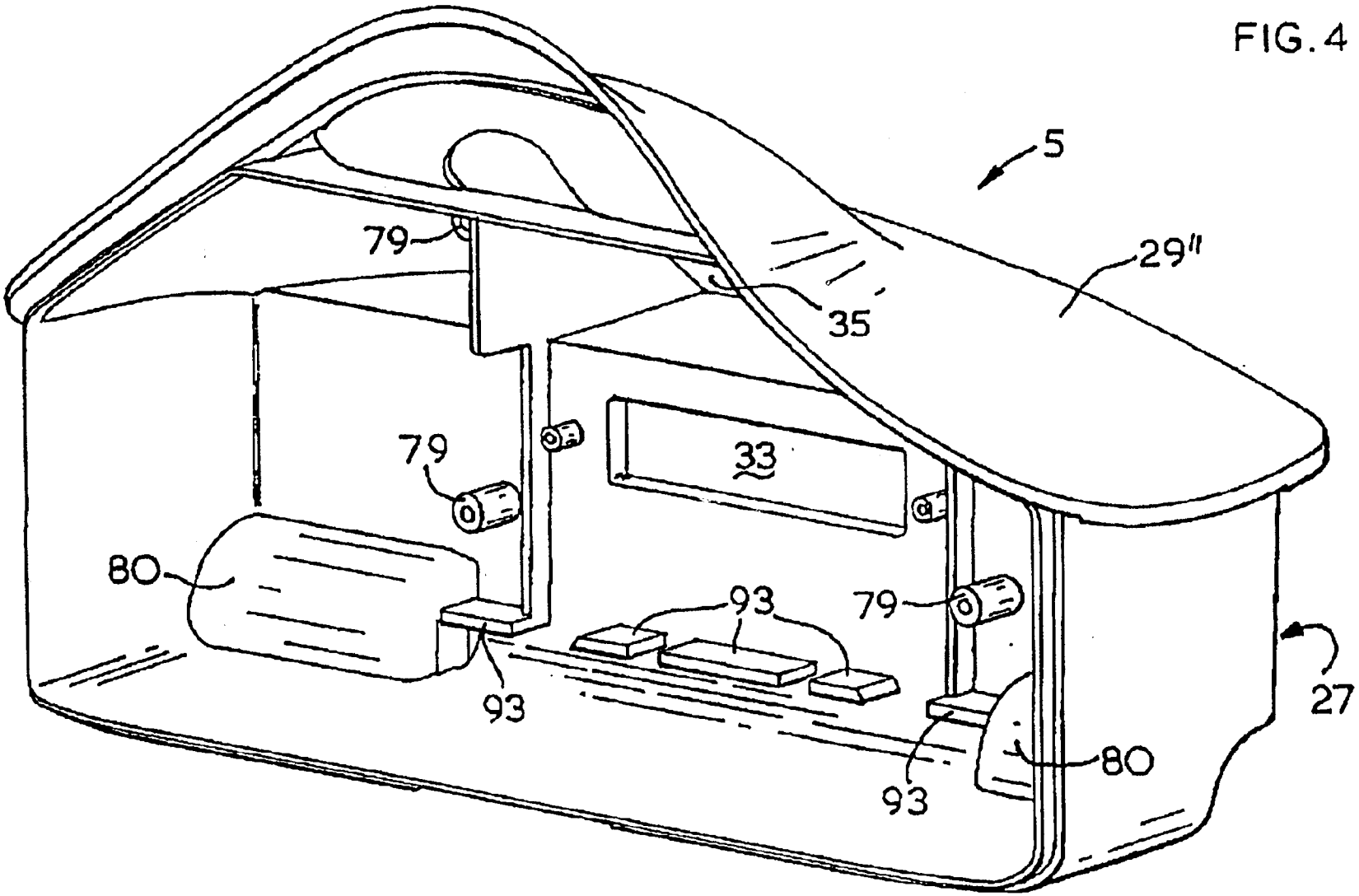
FIG. 4 is a perspective view of the inner surface of the dust bowl of the vacuum cleaner of FIGS. 1A and 1B.

FIG. 4 shows the inner surface of the dust bowl 5, and in particular shows the inwardly directed flanges 93 which are used to prevent upward movement of the latch member 81 relative to the dust bowl 5. It can be seen that five separate parts form the inwardly directed flanges 93, and there are outer spaces 94 and inner spaces 96 between the five separate parts. The purpose of the outer spaces 94 is to allow for passage of projecting portions 138 on the lower surface of the release member 7 to pass through. The purpose of the inner spaces 96 is to allow passage of the projecting flange 135 on the end housing-engagement portions of the latch member 81. These spaces also limit inward and outward movement of the latch member 81. This is described in more detail with reference to FIGS. 5 and 6.

FIG. 4 also illustrates bolts 79 projecting from the inner surface. These are used to engage the backing plate 53 to provide a channel between the dust bowl 5 and the backing plate 53 in which the release member can slide.

FIG. 4 also illustrates two openings 33 and 35 for entry of air into the dust bowl 5, the first being in a first substantially flat faced portion 27 of the front face of the dust bowl, and the second being a recessed portion extending from the first portion 27 first to the front of the vacuum cleaner, and then rearwards in a curved shape (reference 29") to form part of the upper surface of the vacuum cleaner (see also FIG. 1A). Wheel recesses 80 in the body of the dust bowl 5, to accommodate the wheels 67 of the vacuum cleaner (FIG. 3) are also shown.

Figure 5:
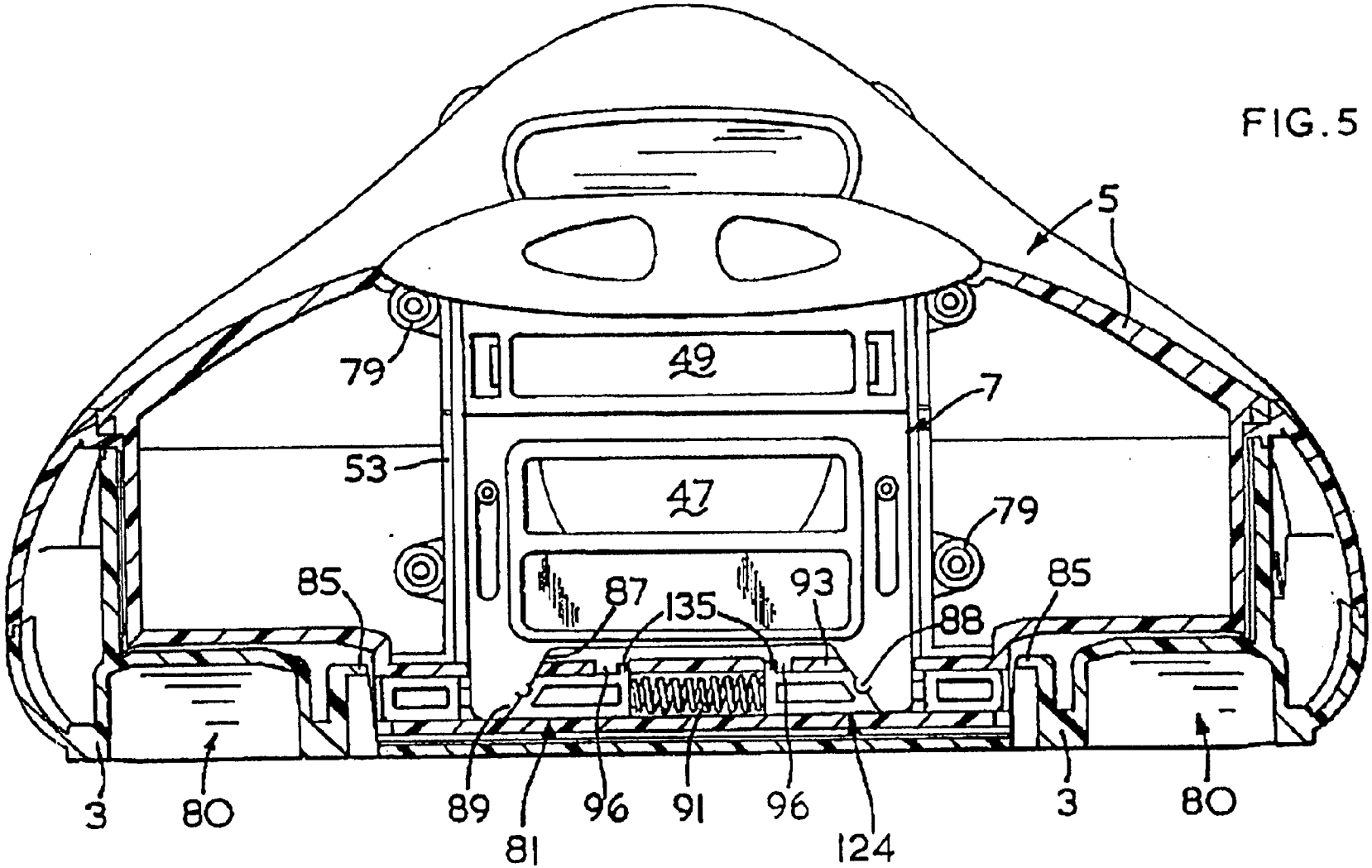
FIG. 5 is a cross-sectional view through the vacuum cleaner of FIG. 1A, taken along the line V—V of FIG. 1A, as viewed from the front of the vacuum cleaner.
Figure 6:
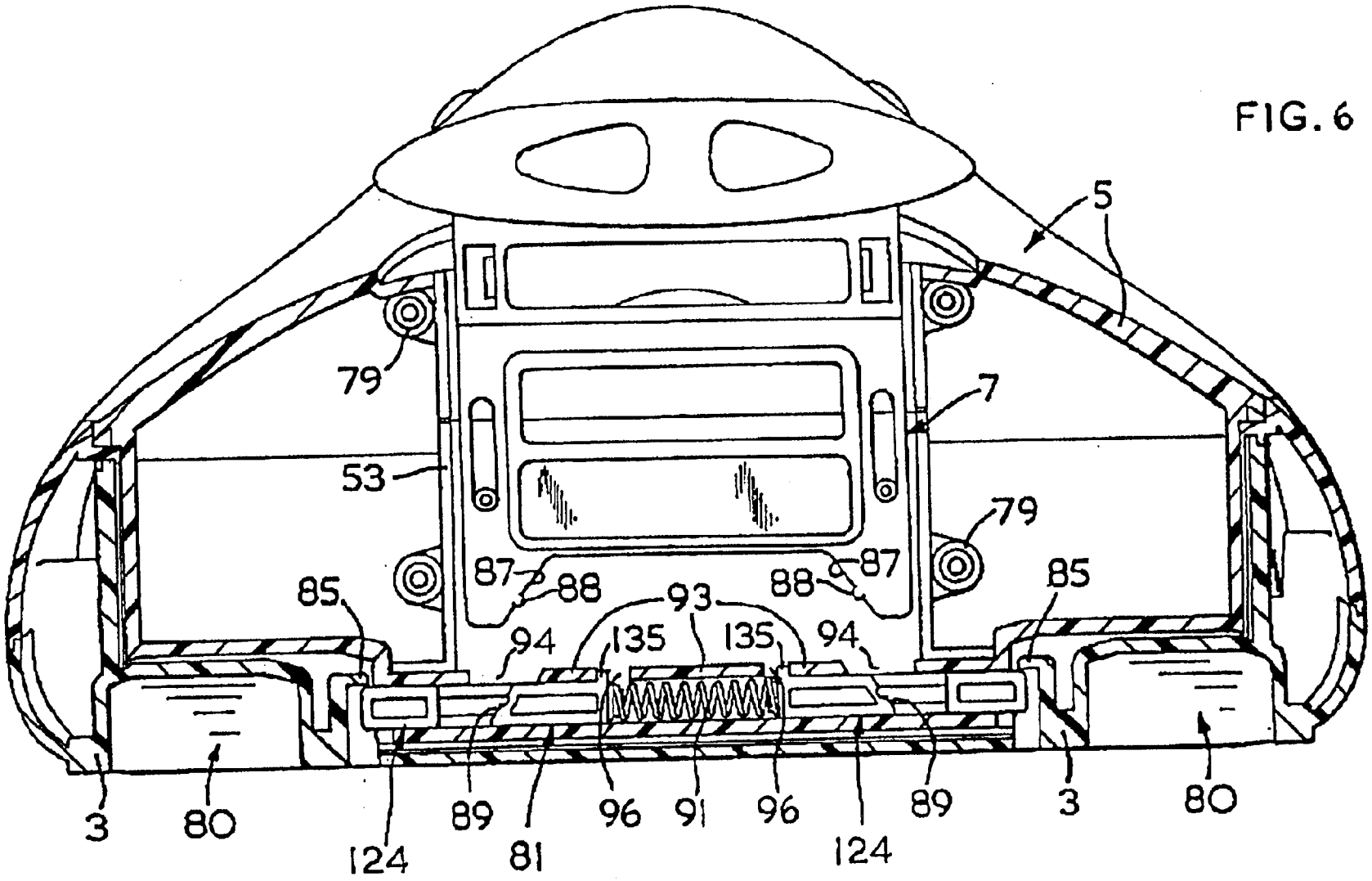
FIG. 6 is a cross-sectional view through the vacuum cleaner of FIG. 1*b*, taken along the line VI—VI of FIG. 1B, as viewed from the front of the vacuum cleaner.

FIGS. 5 and 6 show the operation of the elongate latch member 81 and release member 7 in more detail. These Figures are cross-sectional views of the vacuum cleaner, taken through the shuttle member 7, as viewed from the front of the vacuum cleaner, showing the shuttle in lowered (FIG. 5) and raised (FIG. 6) position. As can be seen by comparison of FIGS. 7 and 8, when the shuttle member 7 is lowered the end housing engagement portions 124 of the spring biased latch member 81 are caused to move towards each other, (i.e. the elongate latch member shortens in length) by the action of co-operating cam surfaces 87 and 89 on the shuttle member 7 and latch member 81 respectively. Inward movement of the end housing-engagement portions 124 is limited by the inner flanges 135 on the end housing-engagement portions 124 which abut against the inner edge of the inner spaces 96 between the separate parts of the inwardly directed flanges 93 from the dust bowl 5. The shortening in length of the latch member 81 acts against the biasing force of a spring member 91 forming the central part of the latch member 81.

When the shuttle member 7 is raised again (FIG. 6), and the cam surfaces 87 and 89 are separated, the spring 91 acts to revert the latch member 81 to its previous longer length. In this case outward movement of the end housing-engagement portions 124 is limited by the inner flanges 135 on the end housing-engagement portions 124 which abut against the outer edge of the inner spaces 96 between the separate parts of the inwardly directed flanges 93 projecting from the dust bowl 5. In this position the end housing-engagement portions 124 of the latch member 81 engage beneath retaining projections 85 on the main housing portion 3. Thus the latch member 81 moves from a first (unlocked) position in which it does not engage a retaining projection 85 on the main housing portion 3, to a second (locked) position where it does engage the retaining projection 85 on the main housing portion 3. Thus by moving the shuttle release member from its lowered position (FIG. 5) to its raised position (FIG. 6) the latch member moves from an unlocked to a locked position. As already described, the latch member's movement relative to the dust bowl 5 is restricted by means of the bottom of the dust bowl 5, flanges 93 directed inwardly from the front face of the dust bowl 5, and a back flange 95 forming part of the shuttle backing plate 53 (see FIG. 3). Therefore by moving the shuttle 7 from its lowered position (FIG. 5) to its raised position (FIG. 6) the latch member 81 moves from a position in which the dust bowl is not locked in place relative to the housing portion 3 of the vacuum cleaner to a position in which it is locked in place relative to the housing portion 3 of the vacuum cleaner.

Figure 7:
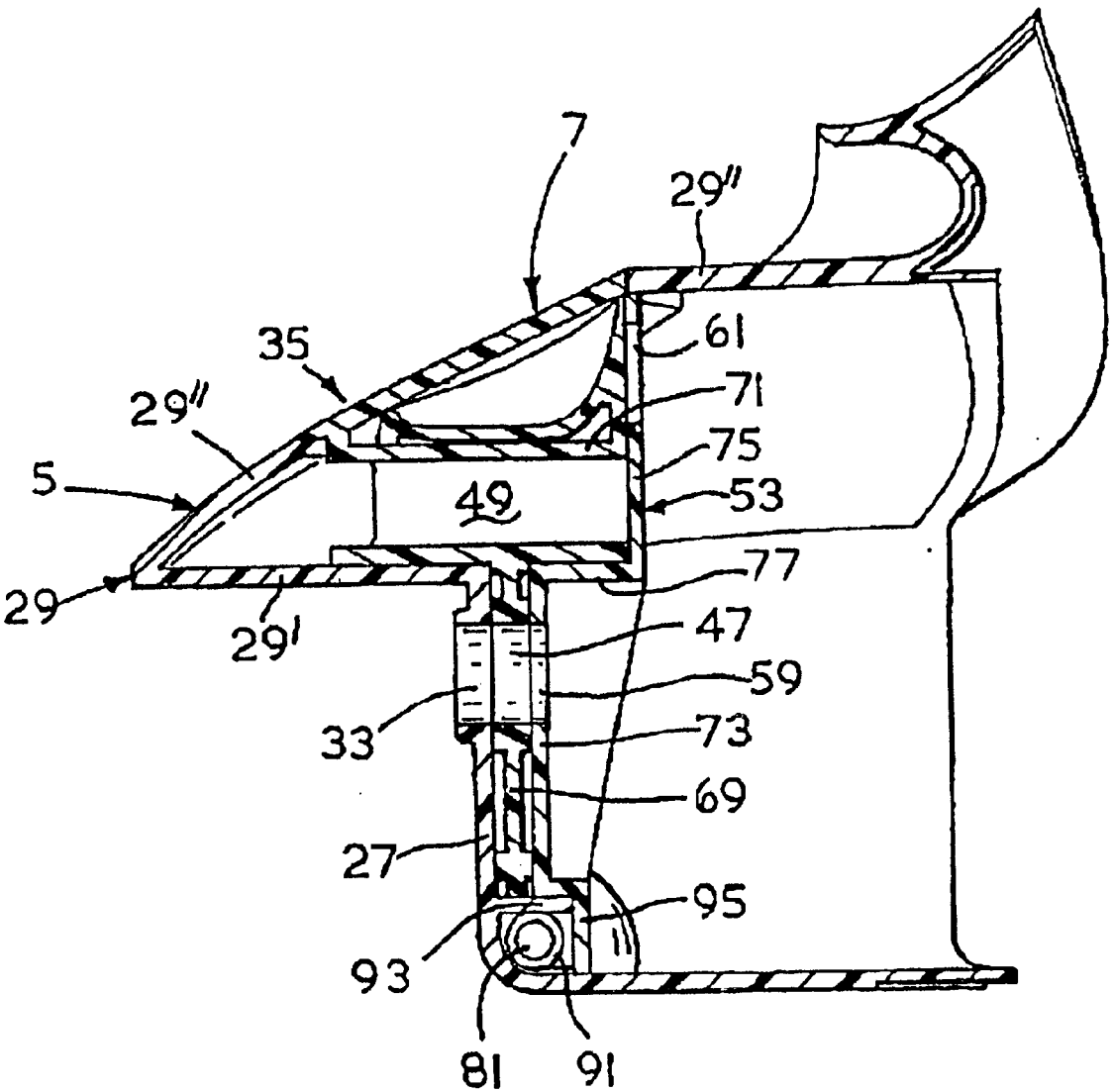
FIG. 7 is an enlarged longitudinal sectional view through the dust bowl and shuttle member only of the vacuum cleaner of FIG. 1.
Figure 8:
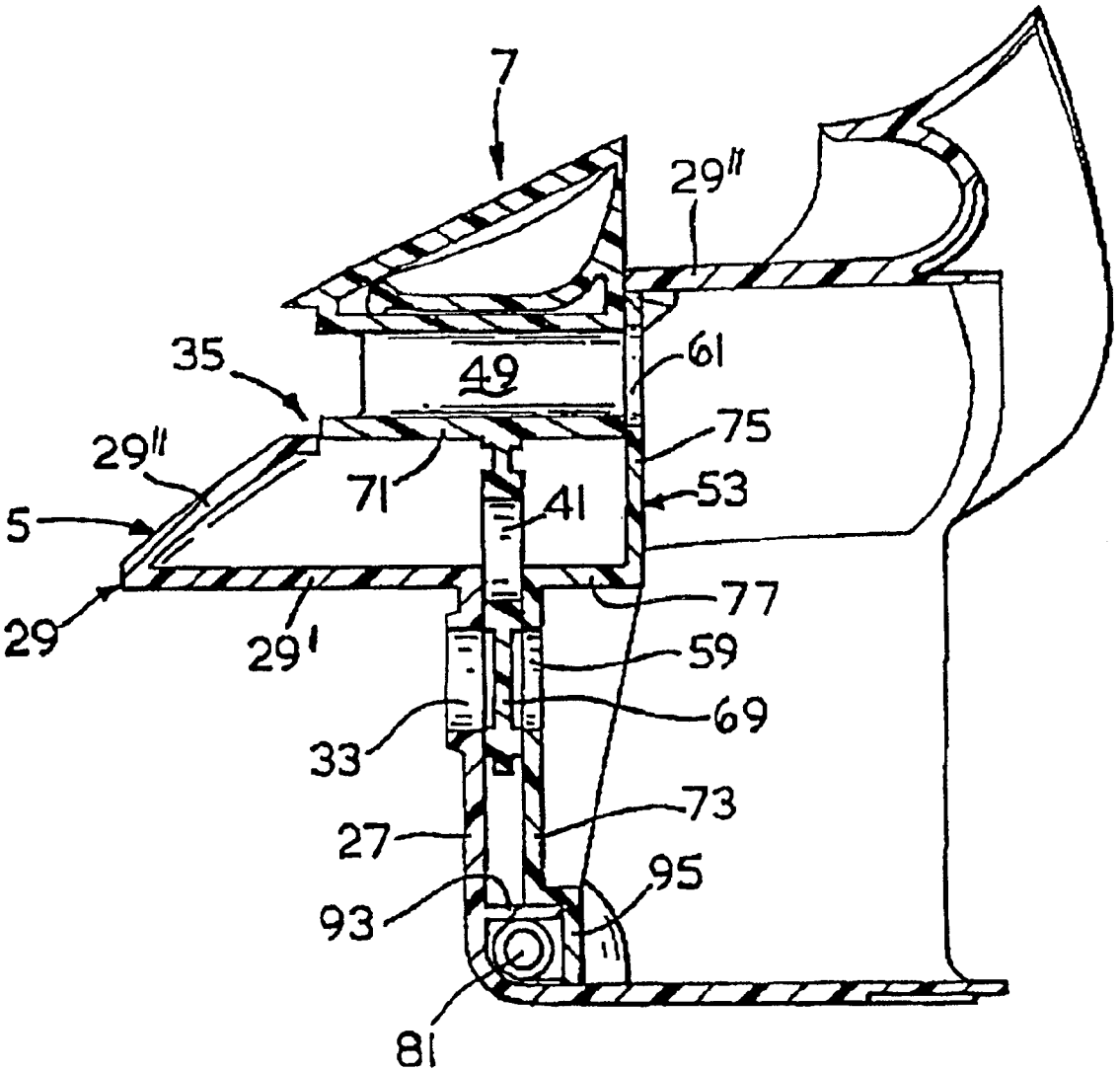
FIG. 8 is an enlarged longitudinal sectional view through the dust bowl and shuttle member only of the vacuum cleaner of FIG. 1.

FIGS. 7 and 8 show in more detail the features of the dust bowl 5, the shuttle member 7 and the backing plate 53 that can co-operate together to cause a change in the air flow path into the dust bowl 5 of the vacuum cleaner. In essence this is achieved by movement of the shuttle member 7 relative to the dust bowl 5. For simplicity FIGS. 7 and 8 show only the dust bowl 5, shuttle member 7 and backing plate 53 and do not show the filter 39 or back cover plate 41 of the dust bowl 7 or other features of the vacuum cleaner.

As can be seen in FIGS. 7 and 8 dust bowl 5 has a front face (facing into the page in FIG. 5) that comprises the first substantially flat faced portion 27 that extends substantially vertically upwards from the lower surface of the main housing portion 3, and the second recessed portion 29 extending from the first portion 27 first to the front of the vacuum cleaner (reference 29'), and then rearwards in the curved shape (reference 29") to form part of the upper surface of the vacuum cleaner (see also FIG. 1A). The front face 27, 29 of the dust bowl contains two apertures for air; a first aperture 33 which is in the first flat faced portion 27 of the front face of the dust bowl, and a second inlet 35 which is in the second recessed portion 29" of the front face of the dust bowl 5.

As already described with reference to FIG. 2, the shuttle member 7 comprises first lower, substantially flat portion 69 integrally moulded with second upper block shaped portion 71. In common with the dust bowl 5, the shuttle member 7 also contains two air inlets; first inlet in the form of a slot shaped aperture 47 in the first substantially flat portion 69 of the shuttle member 7, and second air inlet in the form of a tubular inlet 49 of generally rectangular cross section through the block shaped portion 71 of the shuttle member.

Backing plate 53 comprises a stepped backing surface, comprising first and second substantially flat portions 73, 75 extending substantially parallel to each other and to the first portions 27 and 69 of the dust bowl 5 and shuttle member 7 respectively, and a stepped portion 77 connecting the first and second portions 73, 75 of the backing plate 53. The backing plate 53 comprises two apertures 59, 61 in the first and second portions 73, 75 respectively. Backing plate 53 is secured to the inner surface of the dust bowl 5 by means of attachment nuts which secure to moulded bolts 79 (referred to previously in the description of FIG. 4) projecting inwardly of the dust bowl 5. The arrangement is such that the aperture 33 in the dust bowl 5 is always in register with the aperture 59 in the backing plate 53, and such that the inlet 35 in the dust bowl 5 is always in register with the aperture 61 in the backing plate 53.

The operation of the shuttle member to alter the air flow through the vacuum cleaner is now described. In FIG. 7 the shuttle member 7 is shown in its lowered position, for floor cleaning, and in FIG. 8 the shuttle member 7 is shown in raised position for hose attachment.

In the position shown in FIG. 7, air inlet 33 into the dust bowl 5 (and hence also the aperture 59 in the backing plate) is in register with aperture 47 of the shuttle 7, but the air inlet 35 into the dust bowl (and also the aperture 61 through the backing plate 53) is covered and blocked by part of the shuttle member 7. Hence referring also to FIG. 3 operation of the motor and fan causes air to be drawn through the in register apertures into the dust bowl, i.e. through the floor inlet 43.

In contrast, in the position shown in FIG. 8, air inlet 35 into the dust bowl 5 (and hence also the aperture 61 into the backing plate 53 is in register with the tubular inlet 49 through the shuttle member 7, but the air inlet 33 into the dust bowl (and also the aperture 59 into the backing plate 53) are covered by part of the flat surface 27 of the shuttle member 7. Thus in this case operation of the motor and fan causes air to be drawn through the in-register inlets, i.e.

through the aperture 49 on the upper surface of the vacuum cleaner. A hose attachment may be connected in this position to the tubular inlet 49 of the shuttle member 7 for off the floor use of the vacuum cleaner. It will be appreciated that the fact that only one air flow path is open at any one time ensures that suction power of the vacuum cleaner is not diminished in either position.

It will be noted that in the raised position of the shuttle for hose attachment (FIGS. 6 and 8)the dust bowl 5 is locked in position relative to the vacuum cleaner housing, by the latch member 81. Therefore there is no risk of the dust bowl being lifted accidentally during the hose attachment process.

The operation of the shuttle member to alter the air flow path into the vacuum cleaner forms the subject of contemporaneously filed British Patent Application titled "Airflow Modification in Vacuum Cleaners" (sharing filing date of this Application), GB 2,377,164

Thus a simple design is provided whereby the shuttle release member 7 acts not only detachably to retain the dust bowl relative to the housing portion 3, but also as a means of changing the air flow path into and through the vacuum cleaner from one where suction is from a floor directed inlet to one where suction is through a hose attachment inlet on an upper surface of the vacuum cleaner, and the arrangement is such that dust bowl removal does not accidentally occur when the shuttle member is raised for hose attachment.

What is claimed is:

1. A vacuum cleaner comprising:

a housing;

a motor disposed with said housing for generating a vacuum air flow;

a removable dust collection module carried by said housing;

a latching mechanism for detachably securing said removable dust collection module to said housing, said latching mechanism comprising:

(i) a latch member that can move from a first position in which, in use, it can engage part of the vacuum cleaner housing to a second position in which, in use, it is free from the housing; and (ii) a release member that is movable, in use, relative to the latch member, the movement causing the latch member to move from its said first position to said second position;

(iii) the latch member includes an elongate member having a resilient biasing portion that provides a biasing force tending to urge the latching mechanism towards said first position; and (iv) the latch member further including two end housing engagement portions that are urged into locking engagement with said housing by said biasing force from said resilient biasing portion.

2. The vacuum cleaner according to claim 1, wherein the release member can be moved relative to the latch member to provide a force acting against the biasing force of the biasing portion of the latch member to thereby release the dust collection module from the housing.

3. The vacuum cleaner according to claim 1, wherein the release member is moveable, in use, from a first release-member-position in which it is in contact with the latch member, to a second release-member-position in which it is not in contact with the latch member; and wherein the release member is movable relative to the latch member such that when the release member is in said first release-member-position, where it is in contact with the latch member, then the latch member is in its second position in which it is free from the said housing.

4. A locking mechanism according to claim 3, wherein the release member is movable relative to the latch member such that when the release member is in the said first release-member-position where it is in contact with the latch member then the latch member is in its second position in which it is free from the housing part.

5. The vacuum cleaner according to claim 1, wherein the release member is provided with at lest one cam surface; and wherein the latch member is provided with a corresponding cam surface.

6. The locking mechanism according to claim 5 wherein the latch member is provided with a corresponding cam surface.

7. The vacuum cleaner according to claim 5, wherein the cam surfaces can slide over each other to effect said movement of the latch member from its said first position to said second position.

8. The vacuum cleaner according to claim 5, wherein the release member comprises two cam surfaces, and the latch member comprises two end, housing-engagement portions, each of which is provided with a cam surface shaped to correspond with respective ones of the cam surface on the release member.

9. The vacuum cleaner according to claim 5, wherein said at least one cam surface on the release member is provided with a bearing, and said cam surface of the latch member is provided with a recess shaped to co-operate in a friction fit with said bearing.

10. The vacuum cleaner according to claim 1, wherein the latch member of the locking mechanism is at least partly contained within the dust collection module.

11. The vacuum cleaner according to claim 10, wherein said partial containment of the latch member relative to the dust collection module is effected by at least one inwardly directed flange that projects from an inwardly facing surface of the dust collection module.

12. The vacuum cleaner according to claim 5, further comprising a backing plate positioned so as to locate the release member between itself and the dust collection module; and wherein the backing plate is positioned so as to provide a channel in which the release member can slide.

13. The vacuum cleaner according to claim 12, wherein the backing plate is at least partly contained within the dust collection module; and wherein the latch member is contained within the dust collection module adjacent one surface thereof, and part of the backing plate is positioned substantially to prevent movement of the latch member further into the dust collection module.

14. The vacuum cleaner according to claim 13, wherein the latch member comprises an elongate member, and the release member is contained within the dust collection module so that it can move relative thereto in a direction that is substantially perpendicular to said latch member.

15. The vacuum cleaner according to claim 1, wherein:

the dust collection module comprises an air inlet;

the release member also acts as an air inlet closure member; and movement of the release member relative to the latch member also moves the release member relative to the dust collection module and acts simultaneously to close a first air flow path into the dust collection module and open a second air flow path, that is remote from the first air flow path, into the dust collection module.

16. The vacuum cleaner according to claim 1, wherein the dust collection module comprises two air inlets and the release member comprises a shuttle member containing first and second openings; and whereby movement of the release member relative to the latch member causes the release member to move relative to said air inlets of the dust collection module so that in a first position the first, but not the second, air inlet of the dust collection module is in register with the first opening, and in a second position the second, but not the first, air inlet of the dust collection module is in register with the second opening.

17. The vacuum cleaner according to 16, wherein the release member can be moved relative to said air inlets so that in the first position the first air inlet of the dust collection module is in register with the first opening but the second air inlet of the dust collection module is not in register with either of said openings, and in a second position the second air inlet of the dust collection module is in register with the second opening, but the first air inlet of the dust collection module is not in register with either of said openings.

18. A vacuum cleaner comprising:

a floor engaging housing;

a motor disposed within said housing for generating a vacuum air flow;

a dust collection module removably supported by the housing and forming a portion of an airflow path through the housing;

a latch member operably associated with said dust collection module for securing said dust collection module to said housing such that said dust collection module cannot be removed from said housing; and a release member movable into a first position, wherein the release member assists in forming a first airflow path into said dust collection module and engages said latch member to move said latch member into an unlocked position, whereby said dust collection module can be removed from said housing; and said release member being movable from said first position to a second position, wherein said release member assists in forming a second airflow path, separate from said first airflow path, into said dust collection module and causes said latch member to be urged into a locked position, thereby preventing removal of said dust collection module from said housing.

19. The vacuum cleaner of claim 18, wherein said latch member comprises a pair of end housing-engagement portions and a biasing element, said end housing-engagement portions engaging said housing when said release member is moved into said second position.

20. The vacuum cleaner of claim 18, wherein movement of said release member from said first position into said second position causes said first airflow path to be obstructed; and wherein movement of said release member from said second position into said first position causes said second airflow path to be obstructed.

21. For a vacuum cleaner, a dust collection module adapted to be carried by a housing of the vacuum cleaner, said dust collection module comprising:

a dust bowl adapted to be placed in an opening in said housing;

a latch member carried by said dust bowl for engaging with a portion of said housing to hold said dust bowl secured to said housing; and a release member carried by said housing adjacent said latch member and movable slidably between a first position, wherein said release member engages said latch member to unlatch said dust bowl from said housing, whereby said dust bowl can be removed from said housing, and a second position wherein said release member allows said latch member to engage said housing thereby preventing said dust bowl from being removed from said housing.

22. The dust collection module of claim 21, wherein said latch member comprises a pair of end housing-engagement portions and a spring.

23. The dust collection module of claim 21, wherein said release member assists in forming first and second spaced apart airflow paths into said dust bowl.

24. The dust collection module of claim 23, wherein said second airflow path is obstructed by said release member when said release member is in said first position; and wherein said first airflow path is obstructed by said release member when said release member is in said second position.

25. A method for forming a vacuum cleaner, comprising:

providing a housing having an opening;

providing a motor disposed within the housing for generating a vacuum air flow through a suction nozzle in fluid communication with the housing;

placing a dust collection module within the opening in said housing;

using a latch member to removably secure said dust collection module in said housing;

using a slidably moveable release member to automatically urge said latch member into a locked position when said release member is in a first position, and to allow said latch member to be released from locking engagement with said housing when said release member is moved into a second position; and using said slidably moveable release member to provide a first airflow opening into said dust collection module when said release member is in said first position, and a separate, second airflow opening into said dust collection module when said release member is in said second position.

26. The method of claim 25, further comprising:

using said slidably moveable release member to block said first airflow opening when said slidably moveable release member is in said second position, and to block said second airflow opening when said release member is in said first position.

27. The method of claim 25, further comprising disposing said slidable removable release member within said dust collection module.

28. A vacuum cleaner comprising:

a housing;

a motor disposed within said housing for generating a vacuum air flow;

a removable dust collection module carried by said housing;

a latching mechanism for detachably said removable dust collection module to said housing, the latching mechanism including:

a latch member that can move from a first position in which, in use, it engages part of the vacuum cleaning housing, to a second position in which, in use, it is free from the housing;

a release member that is moveable, in use, relative to the latch member, the movement causing latch member to move from its said first position to said second position;

wherein the release member is provided with at least one cam surface; and wherein the latch member is provided with the corresponding cam surface.

29. A vacuum cleaner comprising:

a housing;

a motor disposed within said housing for generating a vacuum air flow;

a removable dust collection module carried by said housing;

a latching mechanism for detachable securing said removable dust collection module to said housing, the latching mechanism comprising:

a latch member that can move from a first position in which, in use, it engages part of the vacuum cleaner housing to a second position in which, in use, it is free from the housing;

a release member that is movable, in use relative to the latch member, the movement causing the latch member to move from its said first position to said second position; and wherein the latch member of the locking mechanism is at least partially contained with the dust collection module.

* * * * *

UNITED STATES PATENT AND TRADEMARK OFFICE

CERTIFICATE OF CORRECTION

PATENT NO. : 6,836,931 B2
DATED : January 4, 2005
INVENTOR(S) : Daniel Bone

It is certified that error appears in the above-identified patent and that said Letters Patent is hereby corrected as shown below:

Column 12,
Line 11, “lest” should be -- least --.

Column 14,
Line 58, after “detachably” insert -- securing --.
Line 62, “cleaning” should be -- cleaner --.

Column 15,
Line 11, “detachable” should be -- detachably --.

Signed and Sealed this

Twenty-fourth Day of January, 2006

JON W. DUDAS
*Director of the United States Patent and Trademark Office*